United States Patent [19]

Harada

[11] Patent Number: 4,565,904

[45] Date of Patent: Jan. 21, 1986

[54] REMOVAL HANDLE FOR IN-THE-EAR HEARING AIDS

[75] Inventor: Mas Harada, Minneapolis, Minn.

[73] Assignee: Qualitone Hearing Aids, Division of XCor Corp., Minneapolis, Minn.

[21] Appl. No.: 658,562

[22] Filed: Oct. 9, 1984

[51] Int. Cl.[4] ..... H04K 25/02

[52] U.S. Cl. ..... 179/107 E; 381/69

[58] Field of Search ..... 179/107 E, 107 R; 381/68, 69

[56] References Cited

U.S. PATENT DOCUMENTS

| | | | |
|---|---|---|---|
| 3,080,011 | 3/1963 | Henderson | 181/135 |
| 3,265,819 | 8/1966 | Herrmann | 179/107 E |
| 3,312,789 | 4/1967 | Lewis et al. | 179/107 R |
| 4,069,400 | 1/1978 | Johanson et al. | 179/107 E |
| 4,375,016 | 2/1983 | Harada | 179/182 R |

FOREIGN PATENT DOCUMENTS

| | | | |
|---|---|---|---|
| 85032 | 1/1983 | European Pat. Off. | 179/107 R |

*Primary Examiner*—Gene Z. Rubinson
*Assistant Examiner*—Danita R. Byrd
*Attorney, Agent, or Firm*—Schroeder & Siegfried

[57] ABSTRACT

In-the-ear type hearing aid devices having means for receiving and amplifying sound external to the ear are improved by the addition of a handle which aids in the removal of the device from an ear. The handle includes an elongated member which is preferably hingedly mounted to the faceplate portion of the hearing aid device. The free end of the elongated member is enlarged and may be grasped by a hand to facilitate removal of the device from an ear. Preferably, the device includes cooperating detent members which normally holds the handle in a closed, minimally projecting configuration.

5 Claims, 4 Drawing Figures

REMOVAL HANDLE FOR IN-THE-EAR HEARING AIDS

FIELD OF THE INVENTION

This invention relates to the field of hearing aids, and more particularly to in-the-ear hearing aids and means for removing same from an ear canal.

BACKGROUND OF THE INVENTION

The first hearing aids which were worn entirely within an ear typically extended well into the auricle, that portion of the external ear which is not contained within the head. Although useful, these devices were aesthetically unpleasing in that they were visually quite evident. As miniaturization progressed, in-the-ear type hearing aids have become increasingly smaller and now include a type known as the in-the-canal hearing aid.

An in-the-canal hearing aid includes a proximal end portion which is positionable within an ear canal adjacent to an eardrum. A distal end portion extends outwardly towards the auricle of the ear when positioned therein. The auditory canal or external auditory meatus is approximately 1½ inches long if measured from the tragus. The tragus is the cartilaginous projection anterior to the external opening of the ear. Many of the in-the-canal type hearing aids currently extend no further than the tragus. Smaller devices extend only to the bottom of the concha, such that the length of the device is less than 1 inch.

The relatively large in-the-ear type hearing aids could be readily removed from the ear since they extended well into the auricle past the tragus. However, in-the-canal type hearing aids are purposely designed to be aesthetically pleasing in that very little, if any, of the device extends beyond the bottom of the concha. Therefore, it may be very difficult for hearing aid users to remove an in-the-canal type hearing aid or other small in-the-ear hearing aids from their ear. In order to remove such devices, another individual may be required. Alternatively, the user may attempt to extricate the in-the-ear hearing aid by utilizing an implement. Of course, such devices may damage the device or injure the ear, leading to infection or other difficulties.

BRIEF SUMMARY OF THE INVENTION

The present invention provides an improved in-the-ear hearing aid by the addition of an aesthetically pleasing handle means which aids the removal of the device from the ear. The handle includes an elongated member which is hingedly mounted at one end to the exterior of the faceplate of an in-the-ear hearing aid. The free end of the elongated member is enlarged and preferably has a bulbous tip portion which may readily be grasped manually.

Most of the faceplates of in-the-canal and in-the-ear type hearing aid devices include hinged battery doors. In the preferred form of the invention, the removal handle is hingedly mounted to the same hinge which is provided for the battery door. Most preferably, the faceplate and battery door are configured such that all of the handle with the exception of the bulbous tip portion may be positioned within a recess in the hearing aid device. In this manner, when the handle is in the closed position only the enlarged free end of the handle extends beyond the surface of the faceplate. The aesthetically pleasing qualities of the hearing aid device are thereby maintained.

Preferably, the handle may be maintained in a closed position by the addition of cooperating detent members. The handle is thereby held to its least projecting position until a slight outward pull is applied to the enlarged tip portion. Upon application of a slight outward pull to the tip portion the detention is overcome and the handle pivots on its hinge outwardly. The outward projection of the handle may then be readily grasped manually in order to effectuate a safe removal of the in-the-ear hearing aid device from the ear.

BRIEF DESCRIPTION OF THE DRAWINGS

A detailed description of one preferred embodiment of the invention is hereafter described with specific reference being made to the drawings in which.

DETAILED DESCRIPTION OF THE INVENTION

Figure 1:
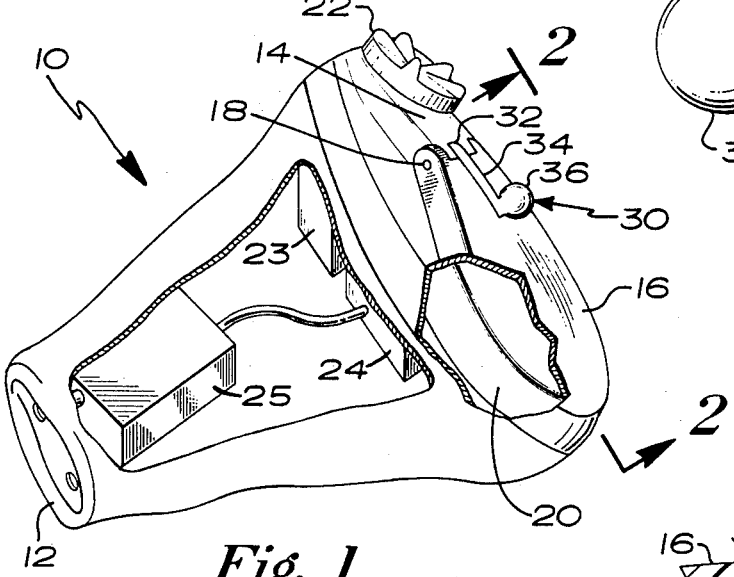
FIG. 1 is a perspective view of a typical in-the-canal type hearing aid having the inventive handle attached thereto, portions are broken away to show the battery.

A typical conventional in-the-canal type hearing aid device 10 is shown in FIG. 1 including the inventive handle 30. Hearing aid device 10 includes a proximal end portion 12 which is positioned within an ear canal adjacent an eardrum. A distal end of device 10 includes a faceplate 14 which typically includes a battery door 16 on its external surface. Battery door 16 is hingedly mounted to faceplate 14 by means of hinge 18. Battery 20 is positioned thereunder. A volume control 22 typically extends slightly beyond the exterior of faceplate 14 as shown. Disposed within the hearing aid device 10 is a microphone 23 that picks up the sound and applies it to an amplifier 24 where it is sent to a receiver 25 in operable fashion.

Handle 30 is an elongated member which includes a hinge end 32, intermediate section 34 and an enlarged distal end 36 as shown in the figures. The enlargement facilitates grasping between the fingers. Handle 30 is hingedly mounted to the external surface of faceplate 14. Preferably, handle 30 is hingedly mounted to hinge 18 of battery door 16. In this manner, fewer parts are utilized and an outward pull on end 36 will not also open the battery door 16.

Figure 3:
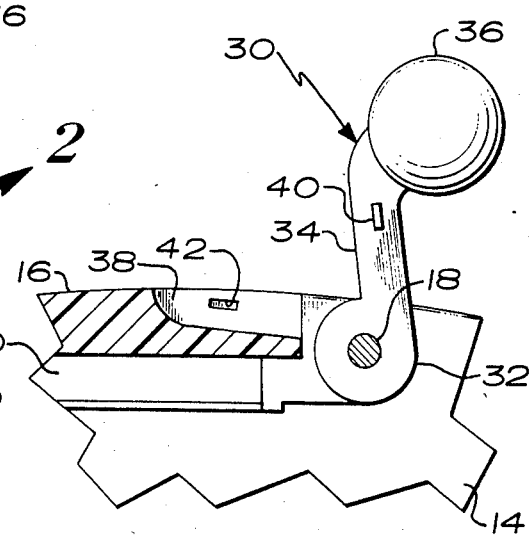
FIG. 3 is a cross-sectional view along line 2—2 of FIG. 1 with the handle in the open, outwardly projecting position.
Figure 2:
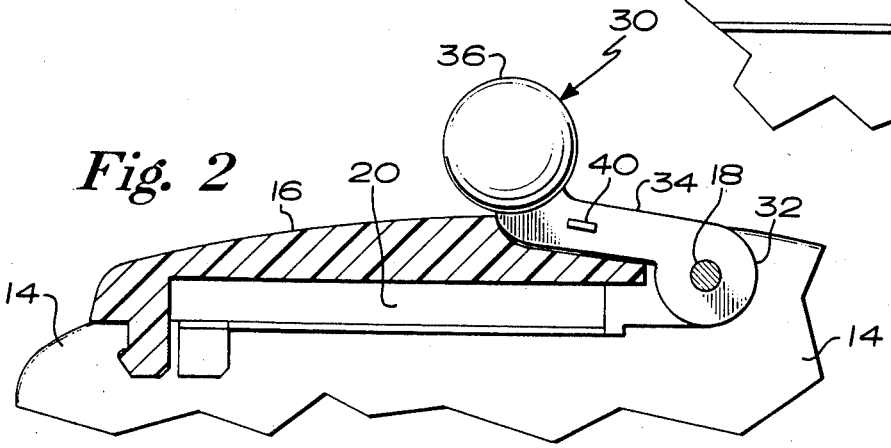
FIG. 2 is a cross-sectional view along lines 2—2 of FIG. 1 showing the handle detented.

Preferably, in order to provide the most aesthetically pleasing appearance to the faceplate, a cavity 38 is provided in faceplate 14 and battery door 16 as shown in FIGS. 2 and 3 such that intermediate section 34 may be positioned there within. In this manner only the bulbous free end 36 of handle 30 projects above faceplate 14.

In order to maintain handle 30 in its normally closed position within cavity 38, cooperating detent members are provided to releasably secure handle 30 within cavity 38. As shown in FIGS. 2 and 3, a detent 40 and a detent socket 42 may be positioned within cavity 38 and intermediate section 34 to provide releasable detention. Of course, any means for providing a releasable detention may be employed. Gravity and the existence of friction may be relied upon to provide some detention rather than positively including detent means.

Figure 4:
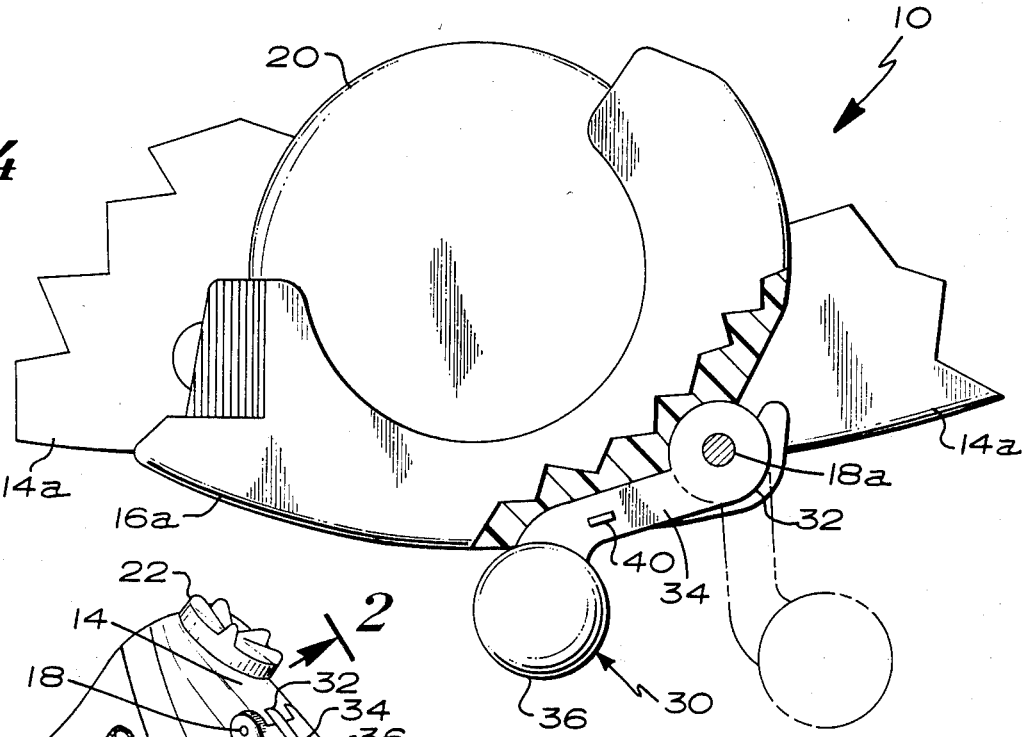
FIG. 4 is a view of an alternative embodiment showing the attachment of the handle to a device having a different battery door construction.

Referring to FIG. 4, faceplate 14*a* of an alternative hearing aid 10 style is shown in which battery door 16*a* is constructed and arranged such that battery 20 is on edge relative to faceplate 14*a* in contrast to the position shown in FIG. 1. Handle 30 may be attached to battery door 16*a* as shown in FIG. 4 through the battery door hinge 18*a*. Preferably, intermediate section 34 resides within a handle cavity as described above. Detent members are also preferably provided. The open extended position of handle 30 is shown by phantom lines in FIG. 4.

In operation, hearing aid 10 is inserted into the ear canal such that proximal end portion 12 is adjacent to the eardrum. When removal is desired, a user merely reaches towards the device and applies a slight outward pull to enlarged end 36 of handle 30. This causes the detention to be overcome, allowing handle 30 to pivot outwardly upon its hinge. Handle 30 may now be readily grasped between a thumb and forefinger. The device is easily and safely removed by an outward pull on the handle.

The advantages of this invention may be achieved through the use of any elongated member which is hingedly attached to the exterior surface of the faceplate of an in-the-ear hearing aid. The free end of the elongated member should have some form of an enlarged end such that a finger or fingernail can catch on the outward projection causing the handle to flip into an open, outwardly projecting position. The handle may then be readily grasped to aid the removal of the device. The removal handle may be advantageously included on any in-the-ear hearing aid, and is especially desirable in miniature in-the-ear devices including in-the-canal aids. In considering this invention, it should be remembered that the disclosure is illustrative only and that the scope of the invention is to be determined by the appended claims.

What is claimed is:

1. An in-the-ear hearing aid device having means for receiving and amplifying sound external to an ear; said device including a proximal receiver end portion which is positionable within an ear canal adjacent an eardrum and a distal faceplate portion facing the outside of an ear when said device is positioned therewithin; the improvement comprising:

(a) handle means for aiding removal of said device from an ear, said handle means including an elongated handle member attached to an exterior surface of said faceplate portion, said handle member being hingedly attached at one end to said portion such that movement of said handle member about said hinge causes an opposite end of said handle member to move toward or away from said faceplate; and (b) said faceplate includes a battery door, hingedly mounted thereto by a hinge pin, said handle member being hingedly mounted to said faceplate through the same said hinge pin.

2. The device of claim 1 wherein said handle member includes a proximal end, an intermediate section and a distal end; said proximal end of said handle member being hingedly mounted to said distal faceplate portion of said hearing aid device, said distal end of said handle member having a greater cross-sectional area then the cross-section of said intermediate section.

3. The device of claim 2 wherein said distal faceplate portion of said hearing aid device includes a recess into which the intermediate section of said handle member is fitted such that only the proximal end of said handle member projects beyond the surface of said distal end portion of said faceplate portion.

4. The device of claim 1 wherein said free end of said handle member has a bulbous shape.

5. The device of claim 4 including cooperating means on said handle member and faceplate, said means being constructed and arranged for providing releasable detention of said handle member to said faceplate such that said handle member is retained on the faceplate until an outward pull is applied to said handle member at said bulbous free end.

* * * * *

UNITED STATES PATENT AND TRADEMARK OFFICE

CERTIFICATE OF CORRECTION

PATENT NO. : 4,565,904

DATED : January 21, 1986

INVENTOR(S) : Mas Harada

It is certified that error appears in the above-identified patent and that said Letters Patent are hereby corrected as shown below:

Column 4, Line 10 after the word "said", insert the word --faceplate--.

Signed and Sealed this

*Twenty-fifth* Day of *March 1986*

[SEAL]

*Attest:*

DONALD J. QUIGG

*Attesting Officer*

*Commissioner of Patents and Trademarks*